US008760074B2

(12) United States Patent
Raj et al.

(10) Patent No.: US 8,760,074 B2
(45) Date of Patent: Jun. 24, 2014

(54) TUNABLE WHITE LUMINAIRE

(75) Inventors: Rashmi K. Raj, Gainesville, VA (US); Jason Rogers, Reston, VA (US)

(73) Assignee: ABL IP Holding LLC, Conyers, GA (US)

( * ) Notice: Subject to any disclaimer, the term of this patent is extended or adjusted under 35 U.S.C. 154(b) by 391 days.

(21) Appl. No.: 13/218,148

(22) Filed: Aug. 25, 2011

(65) Prior Publication Data

US 2013/0049602 A1 Feb. 28, 2013

(51) Int. Cl.
*H05B 33/08* (2006.01)

(52) U.S. Cl.
USPC ..... 315/291; 315/153; 315/308

(58) Field of Classification Search
CPC ..... H05B 37/00; H05B 37/02; H05B 33/00; H05B 33/02; H05B 33/08; H05B 33/0803; H05B 33/0806; H05B 33/0821; H05B 33/0824; H05B 33/0842
USPC ..... 315/291, 307, 308, 312, 149, 159, 157, 315/156, 158, 153; 362/230, 231, 227, 84; 250/216, 227.11, 206
See application file for complete search history.

(56) References Cited

U.S. PATENT DOCUMENTS

| | | | | |
|---|---|---|---|---|
| 6,149,283 | A | 11/2000 | Conway et al. | |
| 6,636,003 | B2 | 10/2003 | Rahm et al. | |
| 6,969,843 | B1 | 11/2005 | Beach et al. | |
| 7,145,125 | B2 | 12/2006 | May et al. | |
| 7,148,632 | B2 | 12/2006 | Berman et al. | |
| 7,768,192 | B2 | 8/2010 | Van De Ven et al. | |
| 7,821,212 | B2 | 10/2010 | Wray | |
| 7,868,557 | B2 * | 1/2011 | Deurenberg et al. | 315/149 |
| 7,959,321 | B2 | 6/2011 | Ryu et al. | |
| 2005/0225976 | A1 | 10/2005 | Zampini et al. | |
| 2006/0049782 | A1 | 3/2006 | Vornsand et al. | |
| 2006/0237636 | A1 | 10/2006 | Lyons et al. | |
| 2006/0268544 | A1 | 11/2006 | Rains Jr. et al. | |
| 2007/0045524 | A1 | 3/2007 | Rains, Jr. et al. | |
| 2007/0182682 | A1 | 8/2007 | Hong et al. | |
| 2008/0205053 | A1 | 8/2008 | Rains et al. | |
| 2010/0244701 | A1 | 9/2010 | Chen et al. | |
| 2010/0259917 | A1 | 10/2010 | Ramer et al. | |
| 2011/0175546 | A1 | 7/2011 | Ramer et al. | |
| 2012/0104953 | A1 * | 5/2012 | Chobot | 315/153 |
| 2012/0306385 | A1 * | 12/2012 | Stefanoff et al. | 315/161 |

OTHER PUBLICATIONS

International Search Report and the Written Opinion of the International Searching Authority issued in International Application No. PCT/US2012/051085 mailed Nov. 2, 2012.

(Continued)

*Primary Examiner* — David H Vu
(74) *Attorney, Agent, or Firm* — RatnerPrestia

(57) ABSTRACT

A system provides white light having a selectable spectral characteristic (e.g. a selectable color temperature and intensity) using a combination of sources (e.g. LEDs) emitting light of four, five, or six different characteristics, for example, one or more white LEDs, and one or more LEDs of each of three primary colors plus cyan and royal blue. A microcontroller can maintain a desired spectral characteristic, e.g. for white light at a selected point on or within a desired range of the black body curve. Further, the microcontroller provides tunability of the spectral characteristic and intensity of the white luminaire. One channel driver drives the one or more first color LEDs (white in our example) as well as the one or more second color LEDs which are connected in series to the first channel driver. The other light sources are each driven by separate drivers on separate channels.

38 Claims, 5 Drawing Sheets

(56) References Cited

OTHER PUBLICATIONS

Entire prosecution history of U.S. Appl. No. 13/972,341, filed Aug. 21, 2013, entitled "Reducing Lumen Variability Over a Range of Color Temperatures of an Output of Tunable-White LED Lighting Devices."

International Preliminary Report on Patentability dated Feb. 24, 2014 in corresponding PCT Application No. PCT/US2012/051085, filed Aug. 16, 2012, entitled "Tunable White Luminaire."

* cited by examiner

TUNABLE WHITE LUMINAIRE

TECHNICAL FIELD

The present teachings relate to techniques and equipment to provide white light having a selectable spectral characteristic (e.g. a selectable color temperature), by combining substantially white light produced by a combination of a white light source and a source of another color of light together with selected amounts of light of one or more additional different wavelengths (e.g. primary colors).

BACKGROUND

In an increasing variety of white lighting applications it is desirable or even possibly required to control the spectral characteristic of the white light. There are many variations of light that appear white. Sunlight, for example, appears warmer than white light from a fluorescent fixture. Light from an incandescent bulb often appears somewhat reddish in color. Yet, humans perceive such lights as 'white.' Even for light that appears 'white' to the human eye, many applications call for different characteristics of the white light. Typical white light sources provide light of a fixed nature, so that it is often necessary to use a different lighting device for each different application. However, with the advent of modern light sources such as light emitting diodes (LEDs) and attendant controls, it is often desirable to change the spectral characteristic of white light from a particular device to suit different needs or desires of a user at different times. For example, at times a user may prefer a cooler light and at other times the user may prefer a warmer light more analogous to sunlight.

It has long been known that combining the light of one color with the light of another color creates a third color. For example, the commonly used primary colors Red, Green, and Blue of different amounts can be combined to produce almost any color in the visible spectrum. Adjustment of the amount of each primary color enables adjustment of the spectral properties of the combined light stream. Recent developments for selectable color systems have utilized LEDs as the sources of the different light colors.

Light emitting diodes (LEDs) were originally developed to provide visible indicators and information displays. For such luminance applications, the LEDs emitted relatively low power. However, in recent years, improved LEDs have become available that produce relatively high intensities of output light. These higher power LEDs, for example, have been used in arrays for traffic lights. Today, LEDs are available in almost any color in the color spectrum. More recently, LEDs have been increasing in popularity for more general lighting in residential and commercial lighting applications.

Traditional LEDs emitted primary light colors. Systems are known which combine controlled amounts of projected light from at least two LEDs of different primary colors. Control of the primary colors included in the combined output light allows the system to generate a wide range of colors in the output of the system, including many variations that appear at least substantially white to human observers.

The introduction of white light LEDs has allowed semiconductor lighting systems to enter the market for more traditional lighting applications without the need for combining light of so many different colors. However, the white light LEDs tend to be relatively cool or bluish to the human observer. To adjust the color, many systems combine the bluish white light LEDs with a LED of a warmer primary color, such as amber or red.

Some of these systems for white lighting tend to provide a relatively static color. For example, a feedback may be provided to enable the microcontroller to adjust the LED outputs to maintain a pre-set temperature of the overall system output. Other systems, however, have allowed the user to set the color of the system output.

For example, United States Patent Application 2006/0268544 A1 by Rains Jr. et al. teaches optical integrating chamber lighting using multiple color sources to adjust white light. The Rains Jr. system provides white light having a selectable spectral characteristic (e.g. a selectable color temperature) using an optical integrating cavity to combine energy of different wavelengths from different sources with white light. The cavity has a diffusely reflective interior surface and an optical aperture for allowing emission of combined light. Control of the intensity of emission of the sources sets the amount of primary color light of each wavelength added to the substantially white input light output and thus determines a spectral characteristic of the white light output through the aperture.

The objective of most systems for general lighting applications is to provide a desired quality of white light of a desired color characteristic, e.g. color temperature of a relatively long usage life. This intent applies even in systems that allow the user to select or tune the output color—it is still desirable when the user sets the color temperature of the white light for the system to produce an acceptable quality of the desired color temperature white light and to maintain the output performance for a long expected usage lifetime.

For example, a problem arises from long-term use of LED type light sources. As the LEDs age, the output intensity for a given input level of the LED drive current decreases. As a result, it may be necessary to increase power to an LED to maintain a desired output level. This increases power consumption. Further, LEDs may not be uniformly bright. In this regard, for a given drive current, light output may vary from chip to chip. As performance of the LEDs of different colors declines differently with age (e.g. due to differences in usage), it may be difficult to maintain desired relative output levels and therefore difficult to maintain the desired spectral characteristics of the combined output. The output levels of LEDs also vary with actual temperature (thermal) that may be caused by difference in ambient conditions or different operational heating and/or cooling of different LEDs. Temperature induced changes in performance cause changes in the spectrum of light output.

Another problem with existing multi-color LED systems arises from control of the overall system output intensity. In existing systems, to adjust the combined output intensity, e.g. to reduce or increase overall brightness, the user must adjust the LED power levels. However, LED spectral characteristics change with changes in power level. If the light colors produced by the LEDs change, due to a power level adjustment, it becomes necessary to adjust the modulations or driver output power to compensate in order to achieve the same spectral characteristic.

To address these issues, many systems utilize optical and/or temperature sensing as feedback to the microcontroller, to adjust the LED operation parameters to maintain a set output intensity and a set output spectral characteristic. Optical sensing has often used sensors configured to sense the overall intensity and/or to sense the intensity of red (R), green (G) and blue (B) light bands encompassing the RGB outputs of the system LEDs. While broadband filters can be used to sense white photons, there is a concern of differentiation from other colored LEDs in the fixture. For example, if there is green light contribution in the light output, the broadband filter may not accurately differentiate the source of the green light, since the white LED spectrum is broadband, and thus includes green.

Hence, a need exists for a technique to efficiently provide white light of a selectable characteristic, with a focus on efficiently provided desired white light performance. A related need exists to control the white light to achieve several color temperatures along the black body curve. A need also exists to efficiently estimate the white photons in order to provide feedback control for respective colored LEDs. Further, a need exists for a system that maximizes the utilization of every LED. Still further, a need also exists for a technique to effectively maintain a desired energy output level and the desired spectral characteristic of the combined output as LED performance decreases with age, preferably without requiring excessive power levels.

SUMMARY

The present teachings generally relate to techniques and equipment to provide white light having a selectable spectral characteristic (e.g. a selectable color temperature), by combining substantially warm white light with selected amounts of light of two or more different wavelengths (e.g. primary colors). A light mixer, diffuser, or the like may be used to combine energy of different wavelengths from different sources.

As disclosed herein, at least one semiconductor light emitting device is configured to produce light of a first color; at least one semiconductor light emitting device is configured to produce light of at least a second color; at least one semiconductor light emitting device is configured to produce light of a third color; and at least one semiconductor light emitting device is configured to produce light of a fourth color. Further, in one example, at least one semiconductor light emitting device is configured to produce light of a fifth color. Still further, there may be a semiconductor light emitting device configured to produce light of a sixth color.

Applicable semiconductor light emitting devices essentially include any of a wide range light emitting or generating devices formed from organic or inorganic semiconductor materials. Examples of solid state light emitting elements include semiconductor laser devices and the like. Many common examples of semiconductor light emitting devices, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Semiconductor light emitting devices may include one or more phosphors and/or nanophosphors based upon quantum dots, which are integrated into elements of the package or light processing elements of the fixture to convert at least some radiant energy to a different more desirable wavelength or range of wavelengths.

In the examples, each source of a specified light wavelength typically comprises one or more light emitting diodes (LEDs). It is possible to install any desirable number of LEDs. Hence, in several examples, the sources may comprise one or more LEDs for emitting light of a first color, and one or more LEDs for emitting light of a second color, wherein the second color is different from the first color. In a similar fashion, the apparatus may include additional LED sources of a third color, a fourth color, etc. To achieve the highest color-quality, the LED array may include LEDs of colors that effectively cover the entire visible spectrum. The LED sources can include any color or wavelength, but typically include Red/Amber/Orange, Green, and Blue. In one embodiment, the first color is warm white. This light is in series with the second color, which is Red, Amber, and/or Orange. The third color is Green and the fourth color is at least one of Blue, Cyan, and Royal Blue. Alternatively, the fourth color can be considered Blue, the fifth color Cyan, and the sixth color Royal Blue.

At least one feedback sensor provides system performance measurements as feedback signals. For example, an RGB color sensor measures the contribution of the second, third, and fourth colors. These measurements can be performed individually for each of the sensed colors. Since each sensor is tuned for a particular color, the measurements can be performed simultaneously. These RGB feedback measurements are used to infer the contribution of the white light. For example, the contribution of the first color can be inferred based on the sensor measurement of the second color A number of other control circuit features also are disclosed. For example, the control circuitry may also include a temperature sensor. In such an example, the logic circuitry is also responsive to the sensed temperature, e.g. to reduce intensity of the source outputs to compensate for temperature increases.

A microcontroller receives and processes these feedback signals. In this regard, the microcontroller can maintain a desired spectral characteristic on the black body curve. Further, it provides tunability of the spectral characteristic and intensity of the white luminaire.

A single first channel driver drives the white LED which is in series with the Red/Amber/Orange LED. Thus, a single channel can drive LED's of several colors. The other lights (i.e., Green and Blue) are each driven by separate drivers on separate respective channels. In one embodiment, similar to the first channel, the third channel may drive at least one of a series Blue, Cyan, and Royal-Blue LED(s). Accordingly, even though more than three colors are used in the luminaire, three channels are sufficient to drive all the LEDs. That is because the first and third channels, each have the capability of driving a plurality of LEDs of different color in series.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In an exemplary general lighting system, for a white light luminaire or the like, the system provides white light having a user selectable spectral characteristic (e.g. a selectable color temperature) using a combination of sources (e.g. LEDs) emitting light of four different characteristics, for example, one or more white LEDs, and one or more LEDs of each of three primary colors. A microcontroller can maintain a desired spectral characteristic, e.g. for white light at a selected point on or within a desired range of the black body curve. Further, the microcontroller provides tunability of the spectral characteristic and intensity of the white luminaire. A microcontroller having a first control channel output connected to control a first channel driver, facilitates driving the one or more first color LEDs (white in our example) as well as the one or more second color LEDs which are connected in series to the first channel driver. The other light sources are each driven by separate drivers on separate channels. The microcontroller is configured to selectively operate the drivers via the control output channels in response to the received user input to cause combined light from the white and non-white light emitting semiconductor devices to produce the selected spectral characteristic for the light output of the tunable lighting system. The controlled light amounts are combined, for example, by an optical integrating cavity, a diffuser or the like. Various feedback strategies are also discussed.

Figure 1:
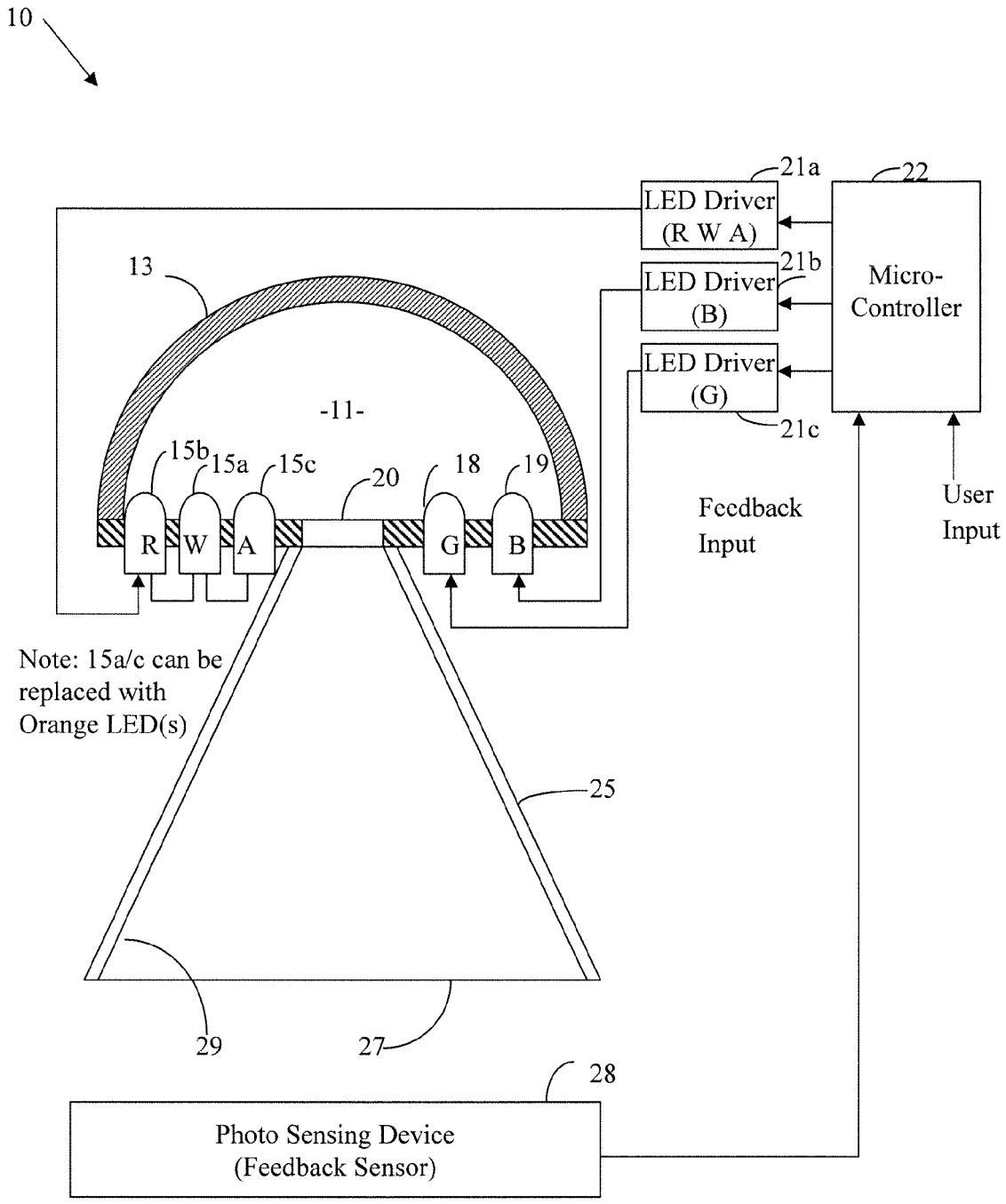
FIG. 1 illustrates an example of a radiant energy emitting system, with certain elements thereof shown in cross-section.

Reference now is made in detail to the examples illustrated in the accompanying drawings and discussed below. FIG. 1 is a cross-sectional illustration of a radiant energy distribution apparatus or system 10. The apparatus or system is intended for general lighting applications in areas or regions intended to be occupied by one or more persons who will see by the light provided by the systems. For example, for task lighting applications, the apparatus emits light in the visible spectrum, although the system 10 may be used for illumination applications and/or with emissions in or extending into the infrared and/or ultraviolet portions of the radiant energy spectrum.

The system combines light from multiple sources, and for that purpose, most examples include an optical light mixer, such as a diffuser. In the example, the illustrated system 10 includes an optical cavity 11 having a diffusely reflective interior surface, to receive and combine radiant energy of different colors/wavelengths. The cavity 11 may have various shapes. The illustrated cross-section would be substantially the same if the cavity is hemispherical or if the cavity is semi-cylindrical with the cross-section taken perpendicular to the longitudinal axis. The optical cavity in the examples discussed below is typically an optical integrating cavity.

The disclosed apparatus may use a variety of different structures or arrangements for the optical integrating cavity. At least a substantial portion of the interior surface(s) of the cavity exhibit(s) diffuse reflectivity. It is desirable that the cavity surface have a highly efficient reflective characteristic, e.g. a reflectivity equal to or greater than 90%, with respect to the relevant wavelengths. In the example of FIG. 1, the surface is highly diffusely reflective to energy in the visible, near-infrared, and ultraviolet wavelengths.

The cavity 11 may be formed of a diffusely reflective plastic material, such as a polypropylene having a 97% reflectivity and a diffuse reflective characteristic. For purposes of the discussion, the cavity 11 in the apparatus 10 is assumed to be hemispherical. In the example, a hemispherical dome 13 and a substantially flat cover plate 15 form the optical cavity 11. At least the interior facing surfaces of the dome 13 and the cover plate 15 are highly diffusely reflective, so that the resulting cavity 11 is highly diffusely reflective with respect to the radiant energy spectrum produced by the device 10. As a result, the cavity 11 is an integrating type optical cavity. Although shown as separate elements, the dome and plate may be formed as an integral unit.

The optical integrating cavity 11 has an optical aperture 20 for allowing emission of combined light energy. In the example, the aperture 20 is a passage through the approximate center of the cover plate 15, although the aperture may be at any other convenient location on the plate 15 or the dome 13. The aperture is transmissive to light. Although shown as a physical passage or opening through the wall or plate of the cavity, those skilled in the art will appreciate that the optical aperture may take the form of a light transmissive material, e.g. transparent or translucent, at the appropriate location on the structure forming the cavity. Because of the diffuse reflectivity within the cavity 11, light within the cavity is integrated before passage out of the optical aperture 20. In the examples, the apparatus 10 is shown emitting the combined light downward through the aperture 20, for convenience. However, the apparatus 10 may be oriented in any desired direction to perform a desired application function, for example to provide visible luminance to persons in a particular direction or location with respect to the fixture or to illuminate a different surface such as a wall, floor or table top. Also, the optical integrating cavity 11 may have more than one aperture 20, for example, oriented to allow emission of integrated light in two or more different directions or regions.

The apparatus 10 also includes sources of light. The sources of light may include a plurality of light emitting diodes (LEDs). These LEDs may emit light at different wavelengths. In one embodiment, there may be a Green LED 18, a Blue LED 19, and a substantially warm White LED 15*a* in series connection with at least one of a Red LED 15*b*, an Amber LED 15*c*, and a phosphor coated Orange LED (not shown). Additional LEDs of the same or different colors may be provided. For example, Blue LED 19 may be replaced with (or be in series connection with) at least one of a Cyan and Royal-Blue LED(s) (not shown). Examples of different LED light combinations include the following:

Fixture 1: White 10; Red 5; Amber 7.

Fixture 2: White 10; Red 4; Phosphor Coated (PC) Amber 7.

Fixture 3: White 14; Orange 7.

Fixture 4: White 10; Red 4; PC Amber 7.

Figure 2A:
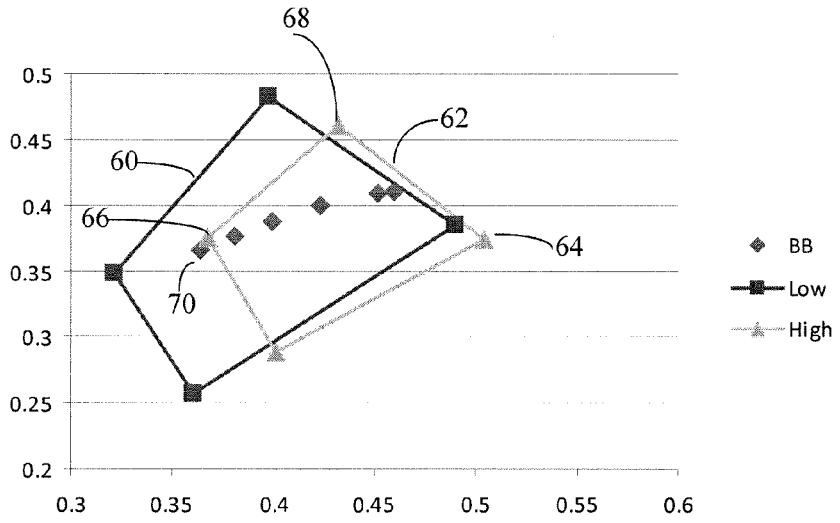
FIG. 2*a* illustrates an example of a CIE chromaticity chart.

FIG. 2*a* illustrates an exemplary CIE chromaticity diagram that can be used to configure the relationship between the LEDs to produce the desired performance. The CIE color space chromaticity diagram depicts all chromas of visible light in terms of X and Y coordinates. The coordinates, when combined with an intensity level, can be converted to CIE tristimulus values which can mathematically define the appearance of a color in accordance with a CIE standard observer.

For example, the wavelengths for each LED are first converted to CIE coordinates. These values are translated to CIE tristimulus coordinates. The tristimulus coordinates provide the color that is produced by each particular LED. The output of each LED for a particular color is multiplied by the number of LEDs of that color. The total output of the string of all LEDs is determined by the summation of the contribution of each color LED and multiplying them by their respective number of LEDs for each respective color. This can be done for best and worst case scenarios. The worst case scenario represents the lowest possible wavelength for a particular color LED, whereas the best case represents the highest possible wavelength for a particular color LED.

In the example of FIG. 2*a*, the vertical axis provides the CIE coordinates while the horizontal axis provides the chromaticity. The left box 60 (i.e., "low") provides the chromaticity range that can be provided by the tunable light system comprising the string of LEDs. In this regard, the rightmost coordinates 64 provide the response when only the White LED(s) are ON (with possibly Red, Amber, and/or Orange). The bottom left coordinates 66 provide the response when the Blue (Cyan and/or Royal Blue) LED(s) are also ON. The top right coordinates 68 provide the response when the Green LED(s) and White LED(s) are ON. The top left coordinates provide the response when all LEDs are ON.

Similarly, the right box 62 (i.e., high) provides the chromaticity of the tunable light system. In this regard, the left box 60 provides the "worst-case" scenario response whereas the right box 62 provides the "best-case" scenario of the LEDs. For example, in a "worst-case" scenario, every LED used has the lowest possible wavelength for its color. In contrast, in the "best-case" scenario every used LED has the highest possible wavelength for its color. In the middle of FIG. 2*a* are dots (i.e., BB) which represent the black body curve.

For example, the goal is for both boxes 60 and 62 to cover the entire black body curve of interest. Indeed, it would indicate that the entire spectrum on the black body curve could be achieved. In this regard, if the left most dot 70 on the black body curve is not of interest, it would be inconsequential that it lies outside the right box 62. However if dot 70 is within the desired chromaticity range, the color and the number of LEDs in each color may be changed to include dot 70 in both box 60 and 62 to assure achieving the desired chromaticity range on the black body curve under both "worst-case" and "best-case" conditions.

Referring back to FIG. 1, LEDs 15 to 19 supply light into the interior of the optical integrating cavity 11. The cavity 11 effectively integrates the energy of different light wavelengths with the substantially warm white light from source 15*a*, so that the integrated or combined light energy emitted through the aperture 20 includes the radiant energy of all the various wavelengths in relative amounts substantially corresponding to the relative intensities of input into the cavity 11. By combining White LEDs 15*a* with one of at least Red LEDs 15*b*, Amber LEDs 15*c*, and Orange LEDs, a warmer color range (i.e., 2700K or warmer) may be provided.

The integrating or mixing capability of the cavity 11 may project light of any color, including white light, by adjusting the intensity of the various sources coupled to the cavity. Hence, it is possible to control color rendering index (CRI), as well as color temperature. For architectural applications, a high CRI value (85 or higher) represents a high-quality white light source.

Figure 2B:
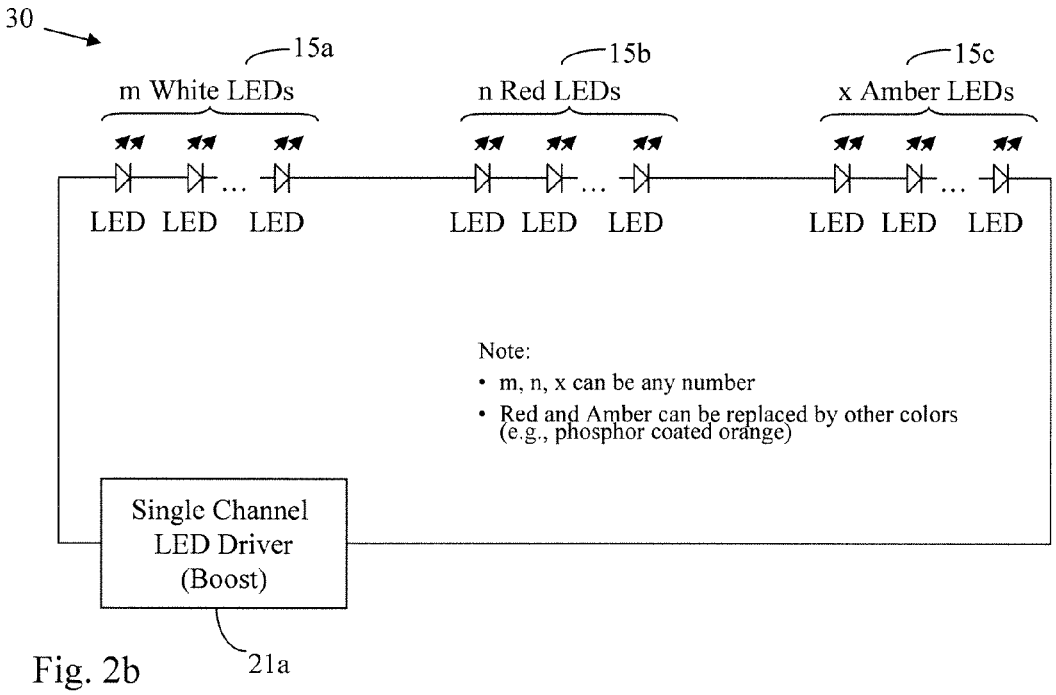
FIG. 2*b* illustrates a single channel LED driver driving a series of white, red and amber LEDs.

The intensity of energy from the substantially warm white light source 15*a* may be fixed, (e.g. by connection to a fixed power supply). Alternatively, the power to the light source 15*a* may be controlled by a microcontroller 22. The microcontroller 22 establishes output intensity of radiant energy of each of the LED sources (i.e., LEDs 15 to 19). For example, the microcontroller 22 may control a plurality of LED channels through respective LED drivers. In this regard, a single channel LED Driver 21*a* may drive a warm white LED 15*a*, in series with at least on of a Red LED 15*b*, Amber LED 15*c*, and an Orange LED. In this regard, FIG. 2*b* illustrates a single channel LED Driver 21*a* coupled to a string of series connected LEDs of different wavelength (i.e., 15*a*, 15*b*, and 15*c*). The string of LEDs may comprise warm White LEDs 15*a* and at least one of Red LEDs 15*b*, Amber LEDs 15*c*. There may be "m" White LEDs, "n" Red LEDs, and "x" Amber LEDs, where m, n, and x can be any real number. It should be noted that in contrast to a traditional approach (which uses cool white LEDs), using a warm white LED and pulling its color temperature up by adding Blue LEDs 19, while reducing the delta UV with the Green LEDs 18 which are used to align the chromaticity of the light output with the black body curve. In this regard, in the traditional approach (i.e., based on cool white LEDs which are pulled down by Red LED's) a substantial number of LEDs are simply left OFF once the desired color temperature is achieved—which is clearly wasteful. Accordingly, the warm white light which is brought up in color temperature, as discussed herein, reduces the LED component count as well as the overall system cost.

As discussed above, the White 15*a*, Red 15*b*, and Amber 15*c* LEDs may be controlled through a single channel. On the other hand, the Blue LED 19 may be driven separately by LED driver 21*b*, while the Green LED 18 may be driven separately by LED driver 21*c*. In one embodiment, a single channel may drive one of at least Blue LED 19, Cyan LED, and Royal Blue LED (Cyan and Blue are not shown). Thus, although more than three colors of LEDs may be used, the microcontroller can control all the LEDs through three separate channels, thereby reducing the number of components required to drive the LEDs.

Control of the intensity of emission of the sources sets a spectral characteristic of the combined white light emitted through the aperture 20 (FIG. 1) of the optical integrating cavity. The microcontroller 22 may be responsive to a number of different control input signals. For example, it may be responsive to one or more user inputs. Further, the microcontroller 22 may be responsive to feedback from the LED light sources 15 to 19. In this regard, feedback may be provided through the photo sensing device 28. In order to use a feedback control for such luminaires, it is desirable to sense white photons. The amount of white light contributed by an LED is not easily determined. While a broadband filter filer may provide such information, it also creates an issue of differentiation from other colored LEDs in the fixture. For example, if there is some green contribution in the light output, it may be difficult for the broadband filter to differentiate the source of the green light. That is because the white LED spectrum is broadband (and thus includes green).

In this regard, in one embodiment, RGB sensors are used to measure the contribution of each color separately. A RED filter is used to determine the relative contribution of the white LEDs 15*a*, since the red filter naturally ignores the green and blue regions of the spectrum. The RGB sensors can be read in serial. Alternately, the RGB sensors can be read in parallel, thereby saving processing time. Thus, as the LEDs 15 to 19 remain ON, one sensor detects the green contribution because it is tuned to detect green light; another detects blue, because it is specifically tuned to detect blue light; etc. Accordingly, the determination of each color contribution can be provided simultaneously. The information from the RGB provides feedback to the microcontroller 22. The microcontroller 22 infers the contribution of the white color based on the feedback sensor measurement of the red color. Other feedback sensors and the operation of the microcontroller are discussed later.

The conical reflector 25 may have a variety of different shapes, depending on the particular lighting application. In the example, where cavity 11 is hemispherical, the cross-section of the conical reflector is typically circular. However, the reflector may be somewhat oval in shape. In applications using a semi-cylindrical cavity, the reflector may be elongated or even rectangular in cross-section. The shape of the aperture 20 also may vary, but will typically match the shape of the small end opening of the reflector 25. Hence, in the example, the aperture 20 would be circular. However, for a device with a semi-cylindrical cavity and a reflector with a rectangular cross-section, the aperture may be rectangular.

In the examples, each source of radiant energy of a particular wavelength comprises one or more light emitting diodes (LEDs). Within the chamber, it is possible to process light received from any desirable number of such LEDs. Hence, in several examples, these sources may comprise one or more LEDs for emitting light of a first color, and one or more LEDs for emitting light of a second color, wherein the second color is different from the first color. In a similar fashion, the apparatus may include additional sources comprising one or more LEDs of a third color, a fourth color, a fifth color, a sixth color, etc. To achieve the highest color rendering index (CRI), the LED array may include LEDs of various wavelengths that cover virtually the entire visible spectrum.

As discussed above, the control circuitry comprises an RGB color sensor coupled to detect color distribution in the integrated radiant energy. Associated logic circuitry, responsive to the detected color distribution, controls the output intensity of the various LEDs, so as to provide a desired color distribution in the integrated radiant energy. In one embodiment the logic circuitry is responsive to the detected color distribution to control the energy output of the different color LEDs, to maintain the desired color distribution in the integrated white light energy.

The inventive devices have numerous applications, and the output intensity and spectral characteristic may be tailored and/or adjusted to suit the particular application. For example, the intensity of the integrated white light emitted through the aperture may be at a level for use in a lumination application or at a level sufficient for a task lighting application. A number of other control circuit features also may be implemented. For example, the control may maintain a set color characteristic in response to feedback from a color sensor. The control circuitry may also include a temperature sensor. In such an example, the logic circuitry is also responsive to the sensed temperature, e.g. to reduce intensity of the source outputs to compensate for temperature increases. The control circuitry may include an appropriate device for manually setting the desired spectral characteristic, for example, one or more variable resistors or one or more dip switches, to allow a user to define or select the desired color distribution.

Automatic controls also are envisioned. For example, the control circuitry may include a data interface coupled to the logic circuitry, for receiving data defining the desired color distribution. Such an interface would allow input of control data from a separate or even remote device, such as a personal computer, personal digital assistant or the like. A number of the devices, with such data interfaces, may be controlled from a common central location or device.

In one embodiment, the control may be somewhat static, e.g. set the desired color reference index or desired color temperature and the overall intensity, and leave the device set-up in that manner for an indefinite period. The apparatus also may be controlled dynamically, for example, to provide special effects lighting. Also, such light settings are easily recorded and reused at a later time or even at a different location using a different system.

To appreciate the features and examples of the control circuitry outlined above, it may be helpful to consider specific examples with reference to appropriate diagrams.

Figure 3:
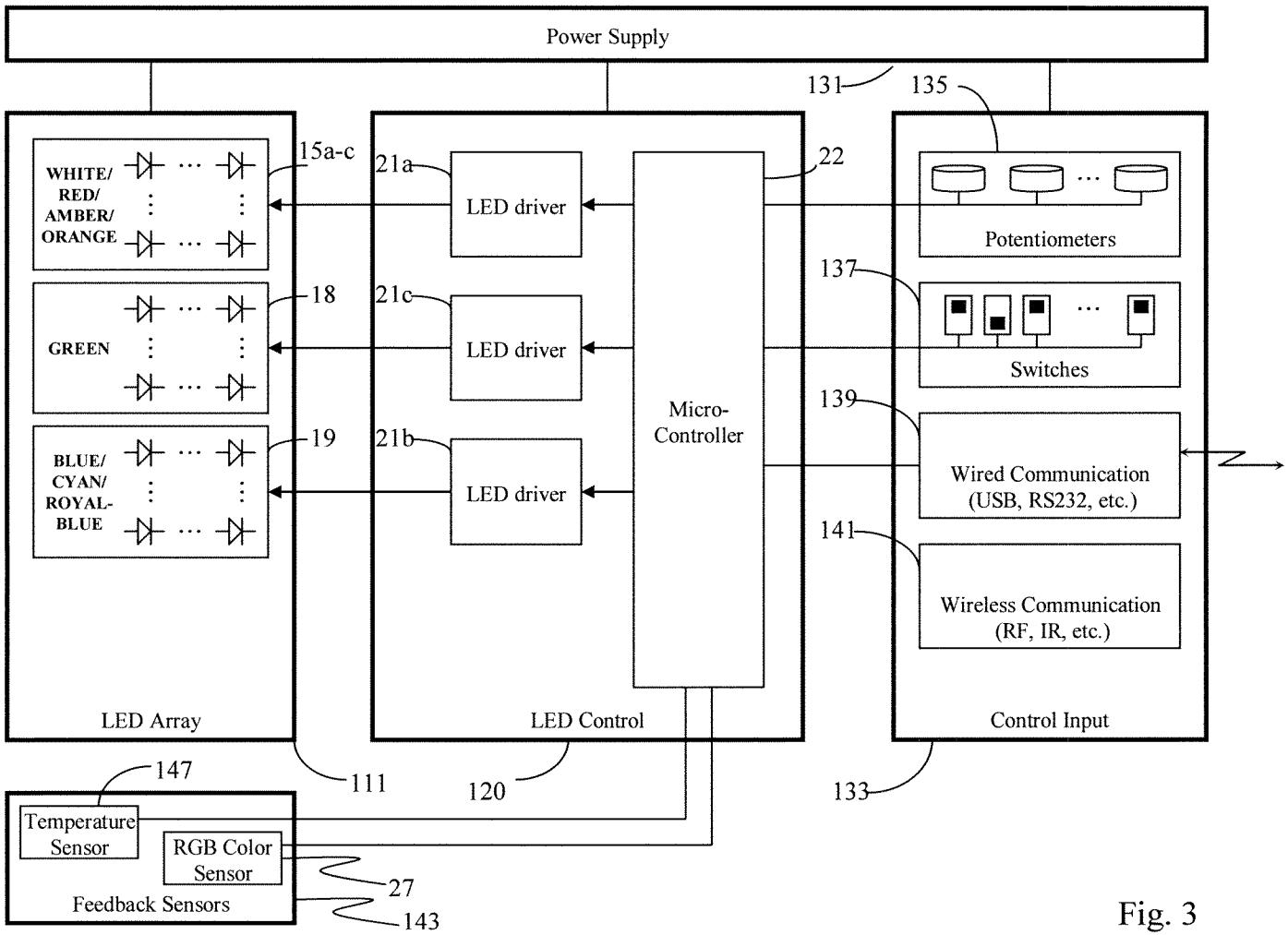
FIG. 3 is a functional block diagram of the electrical components of a radiant energy emitting system using programmable digital control logic, where on of the channels may drive a series combination of LEDs similar to that of FIG. 1.

FIG. 3 is a block diagram of exemplary circuitry for the sources and associated control circuit, providing digital programmable control, which may be utilized with a light integrating fixture of the type discussed above. In this circuit example, the sources of radiant energy of the various types takes the form of an LED array 111. The array 111 comprises at least one Green LED 18, at least one Blue LED 19, and at least one bright white LED in series with at least one Red and/or Amber and/or Orange LED (i.e., 15*a*-15*c*).

The electrical components shown in FIG. 3 also include an LED control system 120. The system 120 includes driver circuits for the various LEDs and a microcontroller. The driver circuits supply electrical current to the respective LEDs 15 to 19 to cause the LEDs to emit light. The driver circuit 21*a* drives the White LEDs 15*a*, in series with Red LEDs 15*b*, Amber LEDs 15*c*, and/or Orange LEDs. The driver circuit 21*b* drives the Blue LEDs 19. The driver circuit 21*c* drives the Green LEDs 18. The intensity of the emitted light of a given LED is proportional to the level of current supplied by the respective driver circuit.

The current output of each driver circuit is controlled by the higher level logic of the system. In this digital control example, that logic is implemented by a programmable microcontroller 22, although those skilled in the art will recognize that the logic could take other forms, such as discrete logic components, an application specific integrated circuit (ASIC), etc.

Figure 4A:
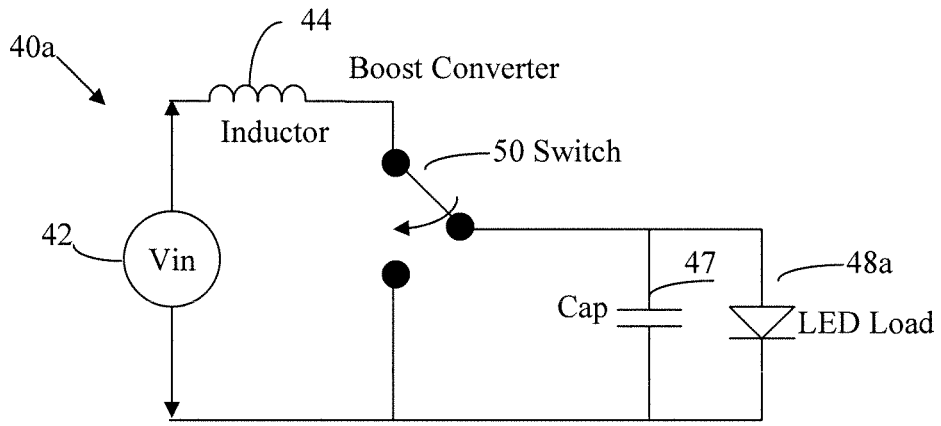
FIG. 4*a* is a schematic of boost converter driving an LED.
Figure 4B:
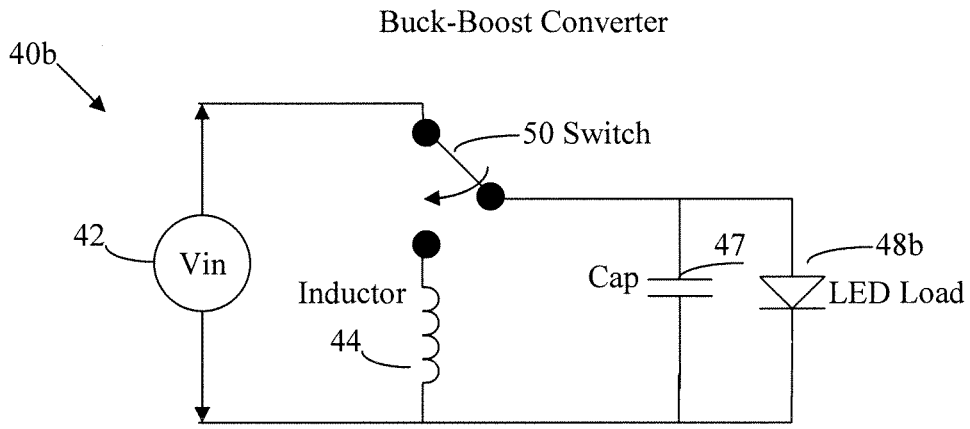
FIG. 4*b* is a schematic of a buck-boost converter driving an LED load.
Figure 4C:
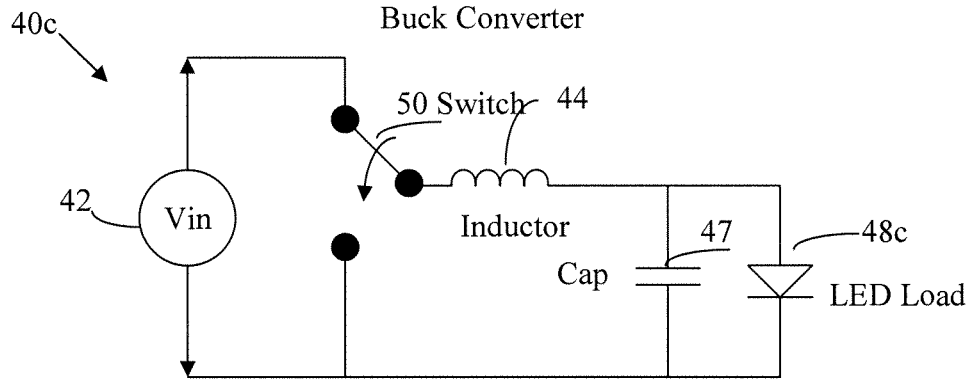
FIG. 4*c* is a schematic of a buck converter driving an LED load.

FIGS. 4*a* to 4*c* illustrate simplified topologies for LED drivers. In one embodiment, for LED string voltages that are substantially higher from an input voltage (element 42) of 24 Volts, a boost topology is used. The boost topology 40*a* is desirable due to its higher efficiency as compared to other topologies. In this regard, LED driver 21*a* of FIG. 1 may use a boost topology 40*a* to drive the White LED 15*b*, in series with at least one of a Red LED 15*b*, Amber LED 15*c*, and Orange LED. Similarly, LED driver 21*c* may also use a boost topology 40*a* to drive the Green LED 18.

For LED strings where the output voltage would be near the input voltage, the buck-boost topology 40*b* is desirable. In one example, the output voltage may be higher or lower than 24V, depending on the LED string voltage. Buck-boost topology 40*b* allows the LEDs to be driven higher or lower than the input bus voltage. This is a feature that the boost or buck topologies cannot provide. Accordingly, LED driver 21*b* of FIG. 1 may use a buck-boost topology 40*b* to drive Blue LED 19.

For LED strings where the LED voltage is always less than the input voltage, the buck converter topology 40*c* can be used. Although the buck converter topology 40*c* can be used to drive Blue LED 19, it is preferable to use a buck-boost topology, as discussed above.

The LED driver circuits 21*a* to 21*c* and the microcontroller 22 receive power from a power supply 131, which is connected to an appropriate power source (not separately shown). For most task-lighting applications, the power source will be an AC line current source, however, some applications may utilize DC power from a battery or the like. The power supply 131 converts the voltage and current from the source to the levels needed by the driver circuits 21*a* to 21*c* and the microcontroller 22.

A programmable microcontroller may include or has coupled thereto random-access memory (RAM) for storing data and read-only memory (ROM) and/or electrically erasable read only memory (EEROM) for storing control programming and any pre-defined operational parameters, such as pre-established light 'recipes.' The microcontroller 22 itself comprises registers and other components for implementing a central processing unit (CPU) and possibly an associated arithmetic logic unit. The CPU implements the program to process data in the desired manner and thereby generate desired control outputs.

The microcontroller 22 is programmed to control the LED driver circuits 21*a* to 21*c* to set the individual output intensities of the LEDs to desired levels, so that the combined white light emitted from the aperture has a desired spectral characteristic and a desired overall intensity. The microcontroller 22 may be programmed to essentially establish and maintain or preset a desired 'recipe' or mixture of the available wavelengths provided by the LEDs used in the particular system. The microcontroller 22 receives control inputs specifying the particular 'recipe' or mixture, as will be discussed below. To insure that the desired mixture is maintained, the microcontroller receives a color feedback signal from an appropriate RGB sensor 27. The microcontroller may also be responsive to a feedback signal from a temperature sensor 147, for example, in or near the optical integrating cavity.

The electrical system may also include one or more control inputs 133 for inputting information instructing the microcontroller 22 as to the desired operational settings. A number of different types of inputs may be used and several alternatives are illustrated for convenience. A given installation may include a selected one or more of the illustrated control input mechanisms. Further, the electrical system may also include one or more digital to analog converters (DACs) (not shown). In this regard, the microcontroller 22 may control the DACs, which in turn provides signals to the respective drivers 21*a* to 21*c*.

As one example, user inputs may take the form of a number of potentiometers 135. The number would typically correspond to the number of different light wavelengths provided by the particular LED array 111. The potentiometers 135 may connect through one or more analog to digital conversion interfaces provided by the microcontroller 22 (or in associated circuitry). To set the parameters for the integrated light output, the user may adjust the potentiometers 135 to set the intensity for each color. The microcontroller 22 senses the input settings and controls the LED driver circuits accordingly, to set corresponding intensity levels for the LEDs providing the light of the various wavelengths.

Another user input implementation might utilize one or more dip switches 137. For example, there might be a series of such switches to input a code corresponding to one of a number of recipes. The memory used by the microcontroller 22 would store the necessary intensity levels for the different color LEDs in the array 111 for each recipe. Based on the input code, the microcontroller 22 retrieves the appropriate recipe from memory. Then, the microcontroller 22 controls the LED driver circuits 21*a* to 21*c* accordingly, to set corresponding intensity levels for the LEDs 15 to 19 providing the light of the various wavelengths.

As an alternative or in addition to the user input in the form of potentiometers 135 or dip switches 137, the microcontroller 22 may be responsive to control data supplied from a separate source or a remote source. For that purpose, some versions of the system will include one or more communication interfaces. One example of a general class of such interfaces is a wired interface 139. One type of wired interface typically enables communications to and/or from a personal computer or the like, typically within the premises in which the fixture operates. Examples of such local wired interfaces include USB, RS-232, and wire-type local area network (LAN) interfaces. Other wired interfaces, such as appropriate modems, might enable cable or telephone line communications with a remote computer, typically outside the premises. Other examples of data interfaces provide wireless communications, as represented by the interface 141. Wireless interfaces, for example, use radio frequency (RF) or infrared (IR) links. The wireless communications may be local on-premises communications, analogous to a wireless local area network (WLAN). Alternatively, the wireless communications may enable communication with a remote device outside the premises, using wireless links to a wide area network.

As noted above, the electrical components may also include one or more feedback sensors 143, to provide system performance measurements as feedback signals to the control logic, implemented in this example by the microcontroller 22. A variety of different sensors may be used, alone or in combination, for different applications. In the illustrated example, the set 143 of feedback sensors includes an RGB color sensor 27 and a temperature sensor 147. Although not shown, other sensors, such as an overall intensity sensor may be used. The sensors are positioned in or around the system to measure the appropriate physical condition, e.g. temperature, color, intensity, etc.

The RGB color sensor 27, for example, is coupled to detect the energy of each separate color. The color sensor may be coupled to sense energy within the optical integrating cavity, within the reflector (if provided) or at a point in the field illuminated by the particular system. In one embodiment, the RGB color sensor 27 may be a Hamamatsu style RGB color sensor.

The associated logic circuitry, responsive to the detected color distribution, controls the output intensity of the various LEDs, so as to provide a desired color distribution in the integrated white light energy, in accord with appropriate settings. The color sensor measures the energy contribution of each color LED and provides a color measurement signal to the microcontroller 22. For example, the signal may be a digital signal (e.g., $I^2C$ bus) derived from a color to frequency conversion.

The temperature sensor 147 may be a simple thermo-electric transducer with an associated analog to digital converter, or a variety of other temperature detectors may be used. The temperature sensor is positioned on or inside of the fixture, typically at a point that is near the LEDs or other sources that produce most of the system heat. The temperature sensor 147 provides a signal representing the measured temperature to the microcontroller 22. The system logic, here implemented by the microcontroller 22, can adjust intensity of one or more of the LEDs in response to the sensed temperature, e.g. to reduce intensity of the source outputs to compensate for temperature increases. The program of the microcontroller 22, however, would typically manipulate the intensities of the various LEDs so as to maintain the desired color balance between the various wavelengths of light used in the system, even though it may vary the overall intensity with temperature.

The above discussion of FIG. 3 is related to programmed digital implementations of the control logic. Those skilled in the art will recognize that the control also may be implemented using analog circuitry. FIG. 3 is a circuit diagram of a simple analog control for a lighting apparatus using White, Red (Amber or Orange), Green, and Blue LEDs. Assume for this discussion that a separate fixed or variable source (not shown) supplies power to a light bulb serving as the white light source. The user establishes the levels of intensity for each type of LED light emission (White/Red/Amber/Orange, Green or Blue) by operating a corresponding one of the potentiometers. The circuitry essentially comprises driver circuits for supplying adjustable power to several sets of LEDs (White/Red/Amber/Orange, Green and Blue) and analog logic circuitry for adjusting the output of each driver circuit in accord with the setting of a corresponding potentiometer. Additional potentiometers and associated circuits would be provided for additional colors of LEDs. Those skilled in the art should be able to implement the illustrated analog driver and control logic of FIG. 3 without further discussion.

Figure 5:
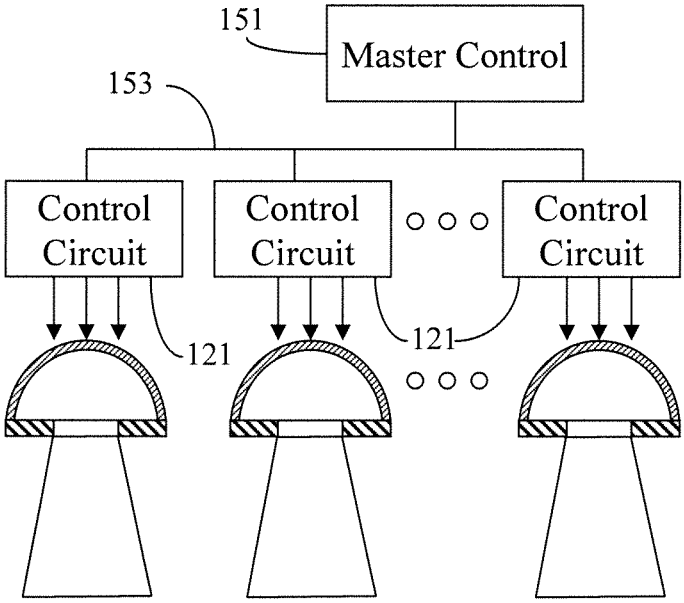
FIG. 5 is a diagram, illustrating a number of radiant energy emitting systems with common control from a master control unit.

The systems described above have a wide range of applications, where there is a desire to set or adjust color provided by a lighting fixture. These include task lighting applications, signal light applications, as wells as applications for illuminating an object or person. Some lighting applications involve a common overall control strategy for a number of the systems. As noted in the discussion of FIG. 3, the control circuitry may include a communication interface 139 or 141 allowing the microcontroller 22 to communicate with another processing system. FIG. 5 illustrates an example in which control circuits 21 of a number of the radiant energy generation systems with the light integrating and distribution type fixture communicate with a master control unit 151 via a communication network 153. The master control unit 151 typically is a programmable computer with an appropriate user interface, such as a personal computer or the like. The communication network 153 may be a LAN or a wide area network, of any desired type. The communications allow an operator to control the color and output intensity of all of the linked systems, for example to provide combined lighting effects.

The examples of the system above take the form of a light fixture of luminaire. Those skilled in the art will appreciate that the tunable lighting system may take other forms. For example, the semiconductor light emitters may be incorporated in a portion of the system analogous to a lamp/light bulb, with the user input and controller incorporated in a fixture or lamp base.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A tunable lighting system, comprising:

a series connected string of a white light emitting semiconductor device and a first non-white color light emitting semiconductor device, the first non-white color of light being one of red, amber and orange;

a first driver connected for applying a controllable drive current to the series connected string of light emitting semiconductor devices to drive the white light emitting semiconductor device and the first non-white color light emitting semiconductor device together in common;

at least one second non-white color light emitting semiconductor device, the second non-white color of light being different from the first non-white color of light;

a second driver connected for applying a controllable drive current to the at least one second non-white color light emitting semiconductor device;

an input for receiving a user input relating to a selection of a spectral characteristic for a light output of the tunable lighting system; and a microcontroller having a first control channel output connected to control the first driver and a second control channel output connected to control the second driver, wherein the microcontroller is configured to selectively operate the drivers via the control channel outputs in response to the received user input to cause combined light from the white and non-white light emitting semiconductor devices to produce the selected spectral characteristic for the light output of the tunable lighting system.

2. The tunable lighting system of claim 1, further comprising:

at least one third non-white color light emitting semiconductor device, the third non-white color of light being different from the first and second non-white colors of light; and a third driver connected for applying a controllable drive current to the at least one third non-white color light emitting semiconductor device;

wherein the microcontroller has a third control channel output connected to control the third control channel output.

3. The tunable lighting system of claim 2, wherein:

the second non-white color of light is green; and the third non-white color of light is one of blue, cyan, and royal blue.

4. The tunable lighting system of claim 2, wherein the series connected string further comprises at least one fourth non-white color light emitting semiconductor device, the fourth non-white color of light being different from the first, second, and third non-white colors of light.

5. The tunable lighting system of claim 4, wherein:

the first non-white color of light is red;

the second non-white color of light is green;

the third non-white color of light is blue; and the fourth non-white color of light is one of amber and orange.

6. The tunable lighting system of claim 4, further comprising at least one fifth non-white color light emitting semiconductor device, the fifth non-white color of light being different from the first, second, third, and fourth non-white colors of light.

7. The tunable lighting system of claim 6, further comprising at least one sixth non-white color light emitting semiconductor device, the sixth non-white color of light being different from the first, second, third, fourth, and fifth non-white colors of light.

8. The tunable lighting system of claim 6, wherein the fifth non-white color of light is cyan.

9. The tunable lighting system of claim 7, wherein:

the fifth non-white color of light is cyan; and the sixth non-white color of light is royal blue.

10. The tunable lighting system of claim 1, further comprising a light mixer coupled to receive and combine light emissions from the white and non-white light emitting semiconductor devices to produce the selected spectral characteristic for the light output of the tunable lighting system.

11. The tunable lighting system of claim 10, wherein the light mixer comprises an optical integrating cavity.

12. The tunable lighting system of claim 1, further comprising a sensor for sensing an operating parameter of the lighting system during operation and connected to provide feedback to the microcontroller.

13. The tunable lighting system of claim 12, wherein the sensor comprises a temperature sensor.

14. The tunable lighting system of claim 12, wherein the sensor comprises a light intensity sensor for sensing intensity of the combined light from the white and non-white light emitting semiconductor devices.

15. The tunable lighting system of claim 12, wherein the sensor comprises a color sensor for sensing a spectral characteristic of the combined light from the white and non-white light emitting semiconductor devices.

16. The tunable lighting system of claim 1, wherein the microcontroller is configured to maintain a desired spectral characteristic on a black body curve for the spectral characteristic for the light output of the tunable lighting system in response to receiving a user input relating to the selection of white light spectral characteristic.

17. A substantially white luminaire, comprising:

at least one light emitting diode (LED) configured to produce light of a first color, the first color being warm white;

at least one LED configured to produce light of at least a second color, the at least second color being one of at least (i) red, (ii) amber, and (iii) orange;

at least one LED configured to produce light of a third color;

at least one LED configured to produce light of a fourth color;

a first channel driver;

a second channel driver; and a third channel driver;

wherein the at least one LED configured to produce light of a first color and the at least one LED configured to produce light of at least the second color are coupled in series and driven by the first channel driver;

wherein the at least one LED configured to produce light of a third color is driven by the second channel driver; and wherein the at least one LED configured to produce light of a fourth color is driven by a third channel driver.

18. The luminaire of claim 17, further comprising at least one LED configured to produce light of a fifth color, wherein the at least one LED configured to produce light of a fifth color is driven by the third channel driver.

19. The luminaire of claim 18, further comprising at least one LED configured to produce light of a sixth color, wherein the at least one LED configured to produce light of a sixth color is driven by the third channel driver.

20. The luminaire of claim 17, further comprising a light mixer for receiving and combining light of the first color, the at least second color, the third color, and the fourth color to create a white light of the desired spectral characteristic on the black body curve.

21. The luminaire of claim 17, further comprising at least one feedback sensor configured to provide system performance measurements as feedback signals.

22. The luminaire of claim 21, further comprising a microcontroller configured to:

receive and process the feedback signals from the at least one feedback sensor;

maintain a desired spectral characteristic on a black body curve; and provide tunability of the spectral characteristic and an intensity of the white luminaire.

23. The luminaire of claim 17, wherein:

the third color is green; and the fourth color is blue.

24. The luminaire of claim 19, wherein:

the third color is green;

the fourth color is blue;

the fifth color is cyan; and the sixth color is royal blue.

25. The luminaire of claim 23, wherein the at least second color is phosphor based.

26. The luminaire of claim 17, wherein:

the first channel driver is of a boost topology;

the second channel driver is of a boost topology; and the third channel driver is of a buck-boost topology.

27. The luminaire of claim 23, wherein:

the feedback sensor comprises RGB color sensors configured to measure the contribution of the at least second color, the third color, and the fourth color individually in parallel; and the microcontroller infers the contribution of the first color based on the feedback sensor measurement of the second color.

28. The luminaire of claim 27, wherein the feedback sensor further comprises a temperature sensor configured to provide a thermal temperature of the luminaire to the microcontroller.

29. A method of providing operating a tunable white luminaire, comprising:

providing LED light of a first color;

providing LED light of at least a second color;

providing LED light of a third color;

providing LED light of a fourth color;

sensing and providing system performance measurements as feedback signals;

receiving and processing the feedback signals;

maintaining a desired spectral characteristic on a black body curve;

tuning the spectral characteristic and intensity of the white luminaire;

receiving and combining light of the first color, the at least second color, the third color, and the fourth color and creating a light of the desired spectral characteristic on the black body curve;

driving the LED of the first color and the LED light of at least the second color via a single first channel;

driving the LED of the third color via a second channel; and driving the LED of the fourth color via a third channel.

30. The method of claim 29, wherein:

the first color is warm white;

the at least second color is one of at least (i) red, (ii) amber, (iii) and orange;

the third color is green; and the fourth color is blue.

31. The method of claim 29, further comprising a fifth color.

32. The method of claim 31, further comprising a sixth color.

33. The method of claim 32, wherein:

the first color is warm white;

the at least second color is one of at least (i) red, (ii) amber, (iii) and orange;

the third color is green;

the fourth color is blue;

the fifth color is cyan; and the sixth color is royal blue.

34. The method of claim 30, wherein the at least second color is phosphor based.

35. The method of claim 34, wherein:

the driving of the LED of the first color and the LED light of the at least second color is via a boost scheme;

the driving of the LED of the third color is via a boost scheme; and the driving of the LED of the fourth color is via a buck-boost scheme.

36. The method of claim 33, wherein:

the driving of the LED of the first color and the LED light of the at least second color is via a boost scheme;

the driving of the LED of the third color is via a boost scheme;

the driving of the LED of the fourth color is via a buck-boost scheme;

the driving of the LED of the fifth color is via a buck-boost scheme; and the driving of the LED of the sixth color is via a buck-boost scheme.

37. The method of claim 29, wherein sensing comprises:

measuring the contribution of the at least second color, the third color, and the fourth color individually in parallel; and inferring the contribution of the first color based on the feedback sensor measurement of the second color.

38. The method of claim 37, wherein the sensing further comprises sensing a thermal temperature of the tunable white luminaire.

* * * * *